US005614153A

United States Patent [19]

Homberg

[11] Patent Number: 5,614,153

[45] Date of Patent: Mar. 25, 1997

[54] PIPETTE TIP EJECTOR

[75] Inventor: William D. Homberg, Oakland, Calif.

[73] Assignee: Rainin Instrument Co., Inc., Emeryville, Calif.

[21] Appl. No.: 451,573

[22] Filed: May 26, 1995

[51] Int. Cl.[6] ..... B01L 3/02

[52] U.S. Cl. ..... 422/100; 73/864.13; 73/864.14; 73/864.15; 73/864.16; 403/329

[58] Field of Search ..... 73/863.01, 863.02, 73/863.05, 864.13, 864.14, 864.15, 864.16, 864.17, 864.18; 422/100; 403/326, 329

[56] References Cited

U.S. PATENT DOCUMENTS

| | | | |
|---|---|---|---|
| 839,297 | 12/1906 | Kennedy et al. | 403/329 X |
| 3,409,858 | 11/1968 | Krehbiel | 403/329 X |
| 3,432,194 | 2/1969 | Garnier | 403/329 X |
| 3,991,617 | 11/1976 | Marteau d'Autry | 73/864.14 |
| 4,009,611 | 3/1977 | Koffer et al. | 73/864.14 |
| 4,247,216 | 1/1981 | Pansini | 403/329 X |
| 4,418,580 | 12/1983 | Satchell et al. | 73/864.13 |
| 4,671,123 | 6/1987 | Magnussen et al. | 73/864.16 |
| 4,909,991 | 3/1990 | Oshikubo | 422/100 |
| 5,320,810 | 6/1994 | Al-Mahareeq et al. | 422/100 |
| 5,413,006 | 5/1995 | D'Autry | 73/864.18 |

*Primary Examiner*—Arlen Soderquist
*Attorney, Agent, or Firm*—Robert R. Meads

[57] ABSTRACT

A pipette tip ejector mechanism for a pipette comprising a releasable connector between a lower end of a pipette tip ejector shaft and an upper end of a pipette tip ejector arm. The connector comprises a female receptor extending from either the shaft or arm and a male connector extending from the other of the shaft or arm to axially fit into the female receptor for support thereby. A cantilever is secured at one end to either the shaft or arm to extend along an outer surface thereof. The cantilever carries one of a locking member or a locking shoulder to engage and lock to the other of the locking member or locking shoulder on the shaft or arm to axially lock the arm relative to the shaft as the male connector is inserted into the female receptor. The cantilever also carries a tab extending outward for finger engagement by a user to outwardly move the cantilever to disengage the locking member from the locking shoulder and to thereby release the arm for axially movement relative to the shaft to allow the arm to be separated from the shaft of the pipette for cleaning, service, replacement or operation of the pipette without the ejector arm which allows access to smaller vessels.

13 Claims, 6 Drawing Sheets

PIPETTE TIP EJECTOR

The present invention relates to pipettes for aspirating and dispensing measured quantities of liquids and, more particularly, to an improved mechanism for ejecting removable pipette tips from a pipette.

In order to prevent cross contamination between successive liquid samples aspirated and dispensed by a pipette, it is common practice for such pipettes to include disposable plastic tips into which measured samples are aspirated during operation of the pipette. After each aspiration and dispensing operation, the removable pipette tip is ejected from the pipette by operation of a pipette tip ejector mechanism.

Various forms of pipette tip ejectors have been utilized over the last 25 years. Possibly the most popular tip ejector for manual pipettes is the ejector for the Gilson "PIPETMAN" pipette, described in U.S. Pat. No. 3,991,617, issued Nov. 16, 1976 (the "'617 Patent"). The tip ejector of the PIPETMAN pipette comprises a push button actuated rod located in a passage provided in an upper part of a hand holdable housing comprising the pipette. The passage and the rod are arranged so as to be able to impart to the rod a movement of translation parallel to an axis of the pipette in opposition to a spring normally urging the rod in an upward direction. A removable tip ejector member or arm including a tubular upper end extends from a lower end of the rod and from the rod follows the general exterior contour of the housing of the pipette to terminate in a sleeve. The sleeve encircles a conical lower end of the pipette housing which tightly receives the upper end of a removable pipette tip. To eject the removable pipette tip from the lower end of the pipette housing, the user grips the pipette housing and using his or her thumb presses downward on the push button. The downward force on the push button is translated by the rod to the tip ejector arm and hence to the sleeve which presses downward on the upper end of the pipette tip. When the downward force transferred by the sleeve exceeds the friction between the pipette tip and the conical lower end of the pipette housing, the pipette tip is propelled from the conical lower end. Upon a release of the push button, the spring returns the tip ejector mechanism to its normal position with the sleeve spaced slightly from the upper end of a replacement pipette tip which is inserted onto the conical lower end of the pipette housing readying the pipette for its next aspiration and dispensing operation.

In order to allow for cleaning and maintenance of the pipette tip ejector arm or operation of the pipette without a tip ejector arm (allowing the pipette tip and conical lower end of the pipette housing to reach into smaller diameter vessels), the tubular upper end of the arm is designed for releasable connection to a lower end of the rod. However, it is very important that the releasable connection be strong enough to ensure that the ejector arm does not disconnect from the ejector shaft during the pipette tip ejection operation. This is of particular concern considering the magnitude of the force required to eject a tightly fitted pipette tip from the conical end of the pipette housing and the magnitude of the momentum of the ejector arm generated during the pipette tip ejection operation. For that reason, the tubular upper end of the ejector arm of the PIPETMAN is designed to provide a very tight interference fit to the lower end of the rod such that a strong downward manual pulling on the ejector arm relative to the rod is required to separate the arm from the rod.

As illustrated and described in the '617 Patent, the tip ejector arm is shaped to follow the exterior contour of the pipette housing and comprises an elongated sheet metal channel facing the pipette housing exposed vertical edges which must be gripped by a pipette user when it is desired to separate the ejector arm from the pipette. Because of the tight friction fit between the upper tubular end of the ejector arm and the rod, to remove the ejector arm from the rod the user must tightly grip the vertical edges of the channel between his or her thumb and forefinger and then exert a strong downward pulling force on the arm to separate the arm from the rod. In practice, this can result in an abrasion or even a cutting of the fingers of the user during the ejector arm removal.

Other more user friendly means for releasably fastening an ejector arm to a pipette tip ejector rod or shaft have been employed including thread connections in the form of a screw or a nut type of fastener. By way of example, such screw or nut-type of fasteners have been utilized in the "EDP", "EDP2" and "EDP-Plus" pipettes manufactured by the Rainin Instrument Co., Inc. and in the "BENCHMATE" pipette manufactured by Nichiryo Co. Ltd. of Tokyo, Japan. While the screw and nut-type fasteners overcome the problems of possible user injury associated with the PIPETMAN pipette, the ejector arm attachment and removal operations take considerably longer than with the PIPETMAN.

Another form of tip ejector arm fastening apparatus features a "snap fit" and includes a hollow plastic ejector shaft and a tubular plastic ejector arm for insertion into an open end of the ejector shaft. The ejector shaft includes an inwardly directed barb while the ejector arm includes a slot in its outer surface. To connect the ejector arm to the ejector shaft a user pushes the arm into the open end of the ejector shaft until the barb snaps into the slot in the outer surface of the arm releasably locking the arm to the shaft. Such installation is relatively simple. However, to disconnect the ejector arm from the ejector shaft is much more difficult and requires a very hard pull on the ejector arm to cause the barb to release from the slot. After several such disconnection operations, the barb becomes worn and less effective in snapping into the slot in the ejector arm. When this occurs, it is possible for the ejector arm to disconnect from the ejector shaft during tip ejection operation. This, of course, is very undesirable. Such a tip ejector arm fastening apparatus is incorporated in the "PROLINE" pipette manufactured by BioHit OY of Helsinki, Finland.

Still other "snap fit" ejector arm fastening structures are incorporated in some models of the "BENCHMATE" pipette and in the "FINNPIPETTE" of LabSystems of Helsinki, Finland.

In the BENCHMATE pipette, a hollow plastic ejector shaft includes a slot in a top surface for receiving a barb extending from an arm depending axially from a tubular plastic ejector arm. The ejector arm is dimensioned to fit within the hollow open end of the ejector shaft with the barb snapping into the slot to lock the ejector arm to the shaft. As with the PROLINE pipette, to separate the ejector arm of the BENCHMATE pipette from the ejector shaft requires the user to exert a strong pulling force on the ejector arm to release the barb from the opening. Further, after several ejector arm removal operations, an end of the slot in the shaft becomes worn and less effective in locking the barb of the ejector arm in the slot. When this occurs, it is possible for the ejector arm to disconnect from the ejector shaft during tip ejection operation. This, of course, is very undesirable.

In the "FINNPIPETTE" pipette tip ejector arm fastening structure includes a hollow plastic ejector shaft having a side opening for receiving a barb extending from the body of a tubular plastic ejector arm. The ejector arm is dimensioned to fit within the open end of the ejector shaft with the barb snapping into the opening. When it is desired to separate the ejector arm from the ejector shaft, a separate tool is inserted by the user under a lip of the plastic ejector shaft to outwardly deform the ejector shaft allowing an axial pulling on the ejector arm to simply remove the barb from the opening in the shaft and the ejector arm to separate from the shaft. While the force required to pull the ejector arm from the ejector shaft is much smaller than that required with the PROLINE or BENCHMATE pipettes, the FINNPIPETTE requires the use of separate tool which is subject to loss or misplacement and unavailability when a user desires to disconnect the ejector arm from the pipette.

Thus, all of the foregoing prior art structures present distinct disadvantages. It is a common characteristic of all such structures that it is relatively difficult or inconvenient to separate the ejector arm from the ejector rod or shaft. Further, in the case of the PIPETMAN pipette, the separation of the ejector arm from the ejector shaft accompanied by discomfort and the possibility of an abrasion or cutting of the users fingers as he or she pulls on the ejector arm to disconnect the arm from the shaft. In case of the BENCHMATE and PROLINE pipettes, a wearing of the "snap" connection structure permits an undesirable separation of the tip ejector arms with the pipette tips during tip ejector operations.

Therefore, there is a need for an improved pipette tip ejector with a reliable mechanism for simply locking and retaining its ejector arm connection to its ejector shaft and for selectively releasing the ejector arm from the ejector shaft for cleaning and other servicing. The present invention satisfies that need.

SUMMARY OF INVENTION

The present invention satisfies the foregoing needs by providing an improved pipette tip ejector mechanism which includes a manually releasable connector between a lower end of a tip ejector shaft and an upper end of a tip ejector arm. The connector comprises a female receptor extending from either the tip ejector shaft or the tip ejector arm and a male connector extending from the other of the shaft or arm to axially fit into the female receptor for support thereby. A cantilever is secured at one end to either the shaft or arm to extend along an outer surface thereof. The cantilever carries either a locking member or a locking shoulder while the shaft or arm carries the other of the locking member or shoulder to axially lock the arm relative to the shaft when the male connector is inserted into the female receptor. The cantilever also carries a tab or tabs extending outward for finger contact by a user to outwardly move the cantilever. Such outward movement of the cantilever disengages the locking member from the locking shoulder and releases the arm for axially movement relative to the shaft to allow the arm to be simply separated from the shaft of the pipette for cleaning, service or replacement or operation of the associated pipette without a tip ejector arm as when it is desired to reach into and aspirate liquid from a narrow diameter vessel.

Preferably, the connector comprises a clip-type connector. When the associated pipette extends in a vertical direction, the female receptor of the clip connector comprises an axially extending channel for connection to either a lower end of the ejector shaft or an upper end of the ejector arm and the cantilever is an axially extending arm carrying the locking member comprising a transverse finger for mating with the locking shoulder to lock the ejector arm to the ejector shaft. The cantilever also carries the tab or tabs. The tab(s) enables a user to manually flex the cantilever transverse to an axis of the pipette to disengage the locking finger from the locking shoulder thereby enabling a simple manual separation of the ejector arm from the ejector shaft.

More particularly, in a first preferred embodiment of the present invention, the channel of the clip connector is secured to an end of the tip ejector arm for axial alignment with an axis of the tip ejector shaft. The cantilever extends axially rearward from the channel along a side of the ejector arm with the transverse finger extending inwardly through a slot in a side of the tubular channel. When the ejector shaft is inserted into the channel of the clip connector, the finger mates with the locking shoulder defined by an annular groove in an outer surface the ejector shaft.

Thus, to connect the ejector arm to the ejector shaft in the first preferred embodiment of the present invention, the user simply moves the ejector arm toward the ejector shaft until the end of the shaft defining the male connector extends into the channel and the transverse finger snaps into the annular groove in the side of the ejector shaft to lock the ejector arm to the ejector shaft. When it is desired to separate the ejector arm from the ejector shaft, the user simply depresses the ejector shaft to expose the clip connector. The user then pushes on the tabs extending from the cantilever and moves the cantilever laterally to separate the finger from the locking shoulder and pulls axially on the ejector arm to separate the ejector arm from the ejector shaft.

In a second preferred embodiment of the present invention, the cantilever of the clip connector is secured to and extends axially along an outside of the ejector shaft with the transverse finger extending inwardly toward the shaft and the tab extending outwardly from the cantilever. An end of the ejector arm includes a tubular channel defining the female receptor for axially receiving an end of the ejector shaft defining the male connector. When it is desired to connect the ejector arm to the ejector shaft in the second preferred embodiment of the present invention, the user simply moves the ejector arm toward the ejector shaft with the shaft extending into the tubular channel of the ejector arm until the transverse finger snaps over an end of the tubular channel defining the locking shoulder to releasably lock the ejector arm to the ejector shaft. When it is desired to separate the ejector arm from the ejector shaft, the user simply depresses the ejector shaft to expose the clip connector, pushes laterally on the tab or tabs extending from the cantilever to move the locking member from the end of the tubular channel and pulls lightly on the ejector arm to separate the ejector arm from the ejector shaft.

In still another preferred embodiment of the present invention, the clip connector comprises a tubular channel extending axially in line with the ejector shaft to define the female receptor. The male connector comprises a rod extending from an end of the ejector arm and including an annular groove defining the locking shoulder for receiving a transverse finger extending inwardly from the cantilever secured to the tubular channel of the clip connector. With such a preferred embodiment of the present invention, when it is desired to connect the ejector arm to the ejector shaft, the user simply moves the ejector arm toward the ejector shaft with the rod inserted into the tubular channel until the transverse finger snaps into the annular groove against the locking shoulder to releasably lock the ejector arm to the ejector shaft. When it is desired to separate the ejector arm from the ejector shaft, the user simply depresses the ejector shaft to expose the clip connector, pushes laterally on the tab or tabs extending from the cantilever to move the finger from the locking shoulder and pulls lightly on the ejector arm to separate the ejector arm from the ejector shaft.

BRIEF DESCRIPTION OF DRAWINGS

FIG. 6 is an enlarged fragmentary side view similar to

FIG. 5 showing the ejector arm separated from the ejector shaft.

DETAILED DESCRIPTION OF THE INVENTION

Figure 1:
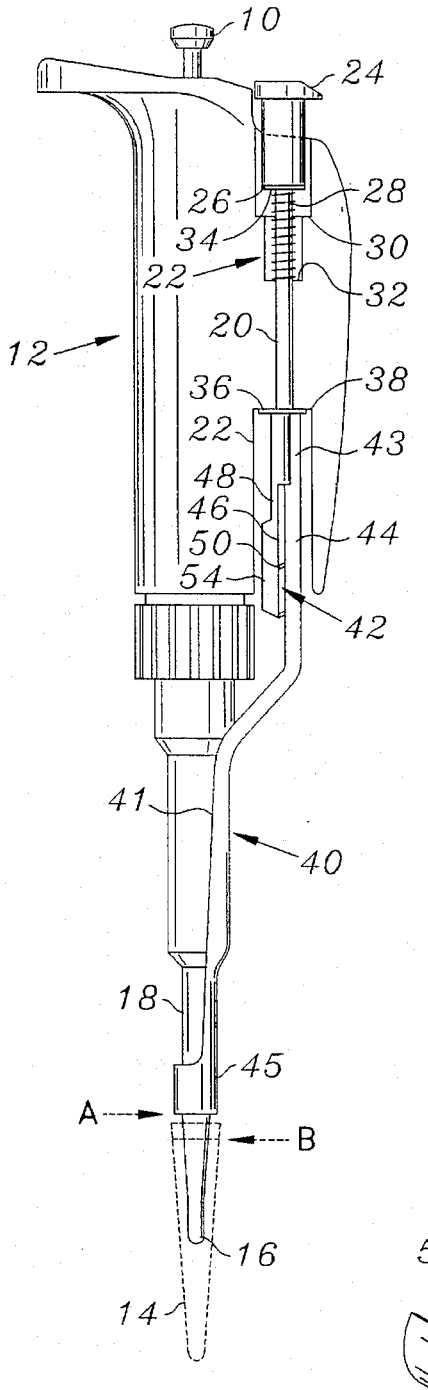
FIG. 1 comprises a side view, partially in section, of a pipette incorporating the improved pipette tip ejector mechanism and clip connector of the present invention.
Figure 2:
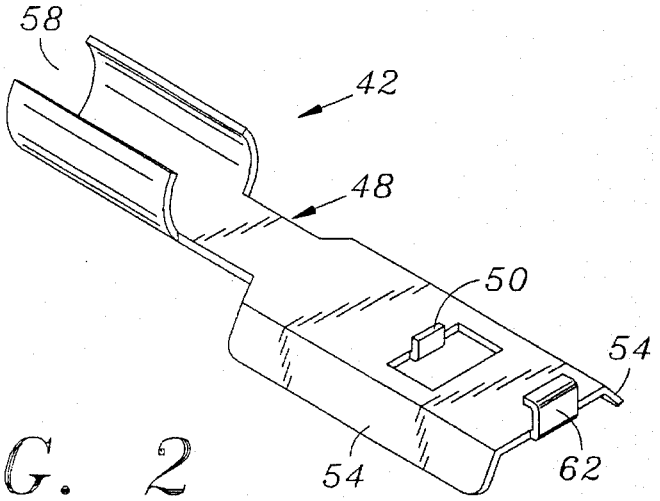
FIG. 2 is a perspective view of a preferred form of the clip connector included in the pipette tip ejector shown in FIG. 1.

The pipette illustrated in the accompanying FIG. 1 comprises a push button 10 connected by a rod to a piston (not shown) located in the body or housing 12 of the pipette. The push button 10 may be depressed by a user exerting a downward force on the push button to cause the downward movement of the piston of the pipette. When the push button 10 is released, the quantity of liquid to be sampled is sucked into a detachable tip 14, releaseably secured to a lower end 16 of the pipette. The sample may then be transferred into another vessel by once more exerting a downward force on the push button 10.

The device for ejecting the removable tip 14 according to the present invention makes it possible to eject the tip without there being any direct contact with the user's hand. Generally, the tip ejection device or mechanism comprises a tip ejection shaft or rod 20 which is incorporated in a passage 22 provided in the housing 12 of the pipette and passing through the housing. At its upper end, the shaft 20 comprises a push button 24 which may be actuated by the user's thumb for the purpose of ejecting the removable tip 14. The push button 24 may be connected to the shaft 20 by any means. Near its upper end and below the push button 24, the shaft 20 carries a stop ring 26. The stop-ring 26 simultaneously fulfills the function of an upper abutment for a coil spring 28 surrounding the shaft 20 and a stop member limiting the downward travel of the shaft 20 by co-operating with a shoulder 30 provided in the passage 22 of the pipette housing. As shown, the coil spring 28 bears at its lower end against a corresponding shoulder 32 and at its upper part against a washer 34.

By this arrangement the spring 28 continuously urges the shaft 20 resiliently upward and thus makes it possible to move the shaft 20 downward by the user pressing downward on the push button 24. Further, the shaft 20 carries a second stop-ring 36 which by co-operation with a corresponding shoulder 38 provided in the passage 22 limits the upward travel of the shaft 20.

Figure 3:
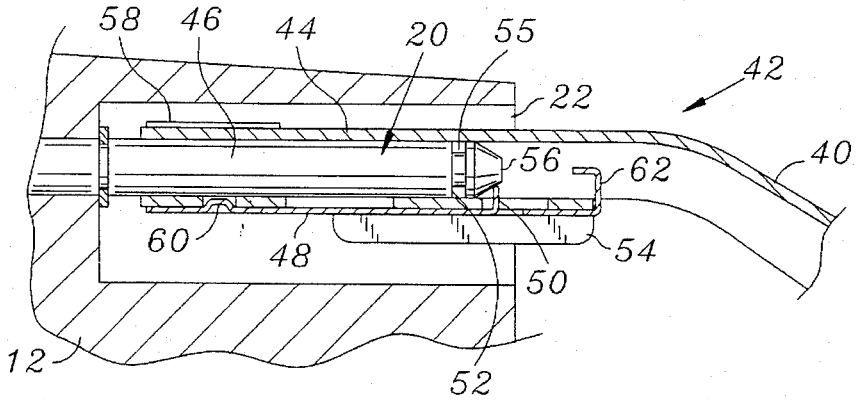
FIG. 3 is an enlarged fragmentary side view of a portion of the pipette tip ejector mechanism illustrated in FIG. 1 depicting the preferred embodiment of the clip connector shown in FIG. 2 between a pipette tip ejector shaft and a pipette ejector arm as the ejector arm is in the process of being installed and connected to the ejector shaft.

Further, the tip ejection device comprises a removable ejection arm 40 releasably secured to the tip ejector shaft 20 by a connector 42. Basically, the connector 42 comprises a female receptor 44 extending from either the tip ejector shaft 20 or tip ejector arm 40 and a male connector 46 extending from the other of the shaft or arm to axially fit into the female receptor 44 for support thereby. A cantilever 48 is secured at one end to either the tip ejector shaft 20 or the tip ejector arm 40 to extend along an outer surface thereof. The cantilever 48 carries a locking member 50 extending transversely inward toward the shaft or arm to engage a locking shoulder 52 (shown for example in FIGS. 3, 9 and 11) to axially lock the arm relative to the shaft. Alternatively, the cantilever 48 may carry the locking shoulder 52 while the locking member 50 extends from the male connector 46 or female receptor 44. Such an alternative is illustrated in FIGS. 13–21 and described hereinafter.

In addition to the locking member or locking shoulder, the cantilever 48 carries a tab or tabs 54 extending outward for contact by the pipette user. By pushing the tab or tabs 54 the user is able to deflect the cantilever to disengage the locking member 50 from the locking shoulder 52 and to thereby release the tip ejector arm 40 for axial movement relative to the tip ejector shaft 20. This allows the tip ejector arm 40 to be easily separated from the tip ejector shaft 20 for cleaning, service or replacement. This also allows the associated pipette to be operated without the ejector arm 40, as when it is desired to aspirate liquids from narrow neck or small diameter vessels.

As illustrated in FIG. 1, the tip ejector arm 40 preferably is shaped to follow the exterior contour of the pipette housing 12 and comprises an elongated sheet metal channel 41 facing the pipette housing 12 and extending from a tubular upper end 43 to a sleeve 45 at its lower end. The tubular upper end 43 is dimensioned to axially receive and releasably connect to a lower end of the tip ejector shaft 20 defining the male connector 46 of the connector 42.

As will be described in detail hereafter, by virtue of the connector 42, the ejector arm 40 is made integral with the ejector shaft 20 and it is only upon a manual release of the connector 42 and a downward pulling on the arm 40 that it is possible to detach the ejection arm from the ejection shaft for washing, decontamination or other servicing of ejector arm or operation of the pipette without the ejector arm to allow access to smaller vessels.

As shown in FIG. 1, the sleeve 45 at the lower end of the ejector arm 40 completely surrounds the lower tubular end of the pipette to provide a maximum lower abutment surface on the top of the disposable pipette tip 14 when it is secured to the lower end 16 of the housing 12. In this regard, the total length of the ejector arm 40 such that when the arm is in its upper position as depicted by the arrow A, i.e. in the inoperative position, its lower end does not reach the top of the tip 14. When a force is exerted by the user's thumb on the push button 24, it produces compression of the coil spring 28 until the washer 34 bears against the shoulder 30. This causes a downward displacement of the ejector shaft 20 and ejector arm 40 guided by the sleeve 45 to the position indicated by the arrow B. During such downward travel of the ejector arm 40 the lower surface of the sleeve 45 bears on the top of the tip 14 to eject the tip from the conical lower end 18 of pipette housing 12.

Figure 4:
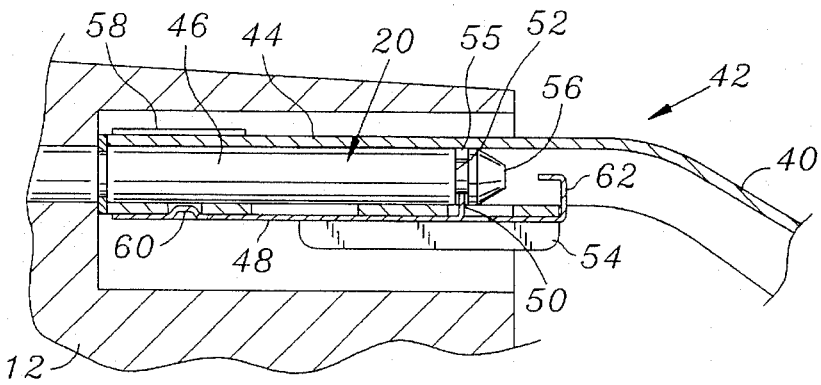
FIG. 4 is an enlarged fragmentary side view similar to FIG. 3 showing the ejector arm completely connected to the ejector shaft.
Figure 5:
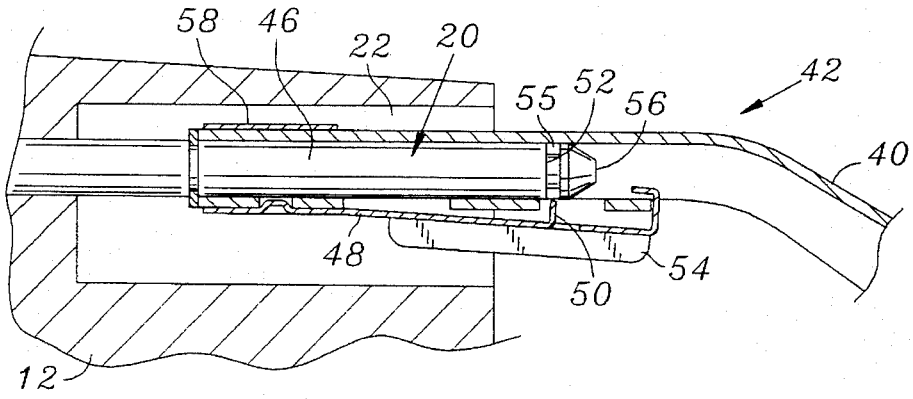
FIG. 5 is an enlarged fragmentary side view similar to FIGS. 3 and 4 showing the condition of the clip connector as the ejector arm is being separated and removed from the ejector shaft.
Figure 6:
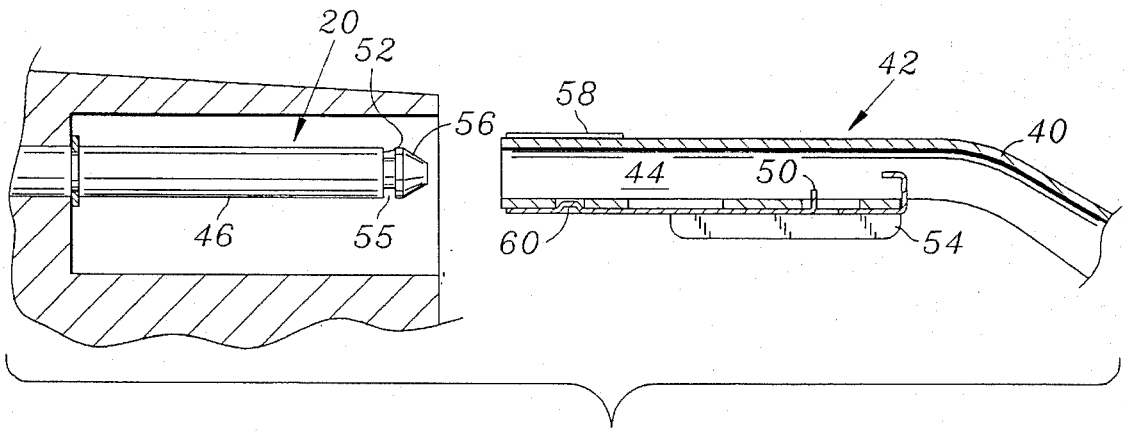

As previously mentioned, the ejector arm 40 is removable from the ejector shaft 20 by virtue of the connector 42. A first improved embodiment of the connector 42 is depicted in FIGS. 2–6. Basically, as illustrated in such figures, the first preferred embodiment of the connector is a clip-type connector including a female receptor, male connector, cantilever, locking member, locking shoulder and tab or tabs, previously referred to generally as items 44, 46, 48, 50, 52 and 54, respectively. In the clip-type connector 42, the male connector 46 is defined by a lower end of the ejector shaft 20 and is dimensioned to fit into the female receptor 44 defined by the tubular upper end of the ejector arm 40. The lower of end of ejector shaft 20 includes an annular groove 55 separating a conical tip end 56 of the shaft from the adjacent body of the shaft 20. One side of the groove 55 defines the locking shoulder 52. To axially lock the ejector arm 40 to the ejector shaft 20, the connector 42 further includes the cantilever 48 secured at one end to the outer surface of the female receptor 44 to extend along an outer surface thereof. In the version of the connector 42 illustrated in FIGS. 2–6, the connection of the cantilever 48 to the outer surface of the female receptor 44 is by a generally C-shaped channel 58 of spring metal material which tightly fits around and receives the tubular end of the ejector arm 40 defining the female receptor 44. As shown, the connection between the cantilever 48 and the female receptor 44 is further enhanced by a button 60 extending inwardly from the cantilever into a hole in a side of the tubular end portion of the ejector arm 40 defining the female receptor 44. Still further, the connection may be enhanced adhesive or by welding or by other suitable means to fixedly connect the cantilever to the ejector arm. The cantilever 48 further carries the locking member 50 illustrated, by way of example, as comprising a finger member extending transversely inwardly toward the ejector shaft 20 as it is located within the tubular upper end of the ejector arm 40 and within the female receptor 44. Further, an end of the cantilever 48 is bent inwardly at 62 to define an end stop for limiting axial movement of the ejector shaft 20 within the female receptor 44. The locking member 50 is defined to fit within the annular groove 55 and to engage the locking shoulder 52 thereof to limit relative axial movement between the ejector arm 40 and the ejector shaft 20. Thus, referring to FIGS. 3 and 4 and the illustrated manner in which the ejector arm 40 is installed on the ejector shaft 20, the pipette user simply moves the ejector arm 40 to a location adjacent the lower end of the passage 22. If desired, the user may then depress the push button 24 to axially move the ejector shaft downwardly to expose the lower end of the ejector shaft to the lower open end of the passage 22. In any event, the user then simply moves the ejector arm in line with the ejector shaft 20 to permit the male connector 46 to fit into the female receptor 44. As the male connector 46 moves into the female receptor 44, the conical end of the ejector shaft engages the locking member 50. The conical surface exerts an outward force on the locking member 50 to move the cantilever laterally until the conical end of the shaft passes the locking member 50 enabling and the locking member to snap inwardly into the groove with the locking member 50 engaging locking shoulder 52 as shown in FIG. 4. When it is desired to remove the ejector arm 40 from the ejector shaft 20, the user simply pushes with his thumb and forefinger on the tab or tabs 54 extending transversely outward from the cantilever 48. To accommodate such pushing action, the user first presses downward on the push button 24 to move the ejector shaft 20 downward in the passage 22. This is most clearly shown in FIG. 5. The user then pushes on the tabs 54 to move the cantilever 48 away from the ejector arm 40 to disengage the locking member 50 from the locking shoulder 52 as illustrated. Then by simply pulling on the ejector arm 40, the user separates the ejector arm from the ejector shaft as shown in FIG. 6.

Figure 7:
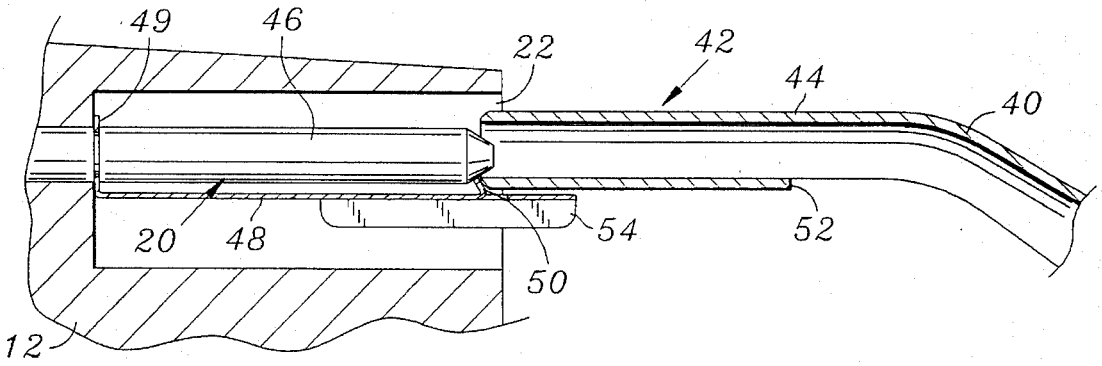
FIG. 7 is an enlarged fragmentary side view of a second preferred embodiment of the connector between the ejector arm and ejector shaft with the ejector arm ready for attachment to the ejector shaft.
Figure 8:
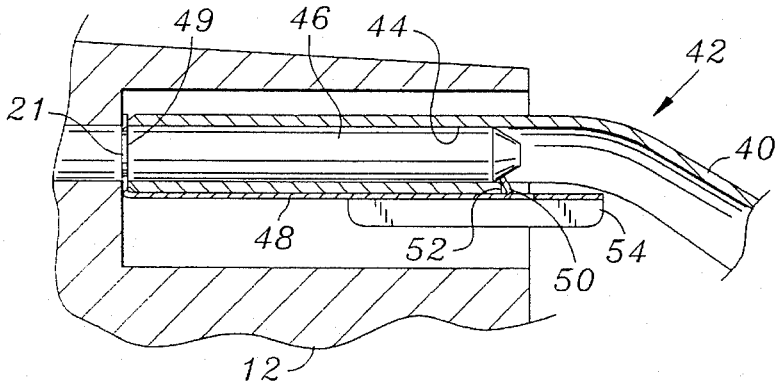
FIG. 8 is an enlarged fragmentary side view similar to FIG. 7 depicting the ejector arm connected to the ejector shaft.
Figure 9:
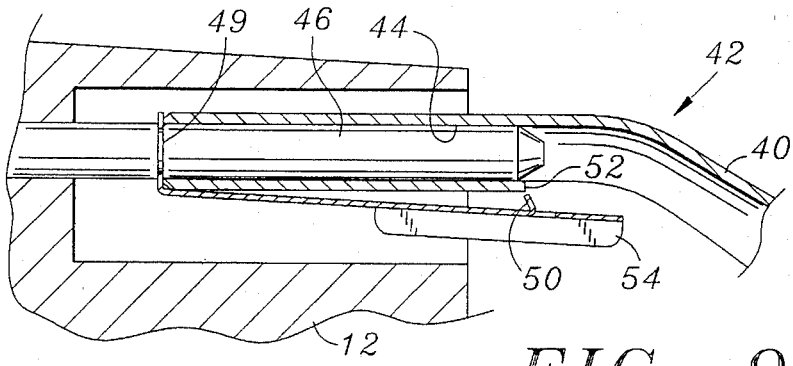
FIG. 9 is an enlarged fragmentary side view similar to FIG. 8 with the ejector arm in the process of being separated from the ejector shaft.
Figure 10:
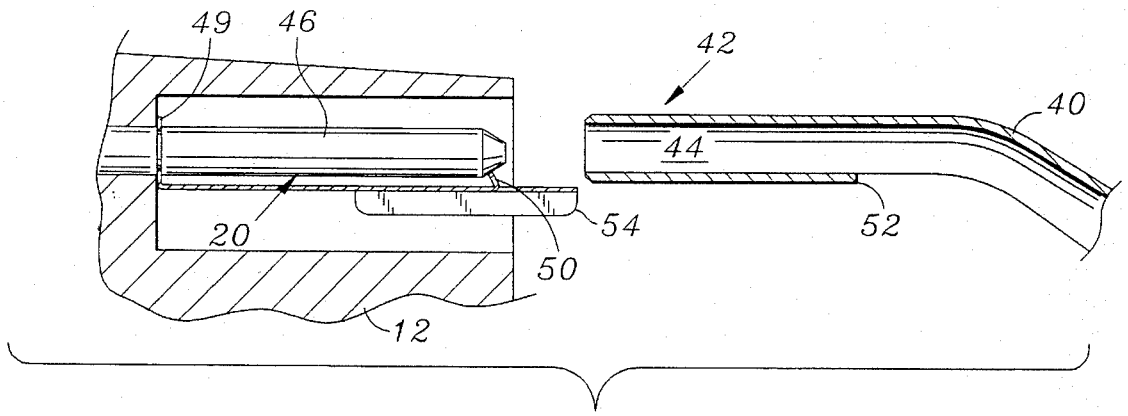
FIG. 10 is an enlarged fragmentary side view similar to FIG. 9 showing the ejector arm separated from the ejector shaft.

A second preferred embodiment of the connector 42 for releasably connecting the ejector arm 40 to the ejector shaft 20 is depicted in FIGS. 7–10. In FIGS. 7 and 8, the method of installation of the ejector arm 40 on the ejector shaft 20 is depicted. In FIGS. 9 and 10, the method of removal of the ejector arm from the ejector shaft is illustrated for the second and preferred embodiment of the connector 42. As shown in FIG. 7, the second preferred embodiment of the connector 42 comprises the female receptor 44 defined by the tubular upper end of the ejector arm 40, an end of the tubular section defining the locking shoulder 52. The male connector 46 comprises the lower end of the ejector shaft 20. The cantilever 48 is secured to the end of the ejector shaft 20 comprising the male connector to extend axially along an outer surface of the ejector shaft. The cantilever 48 is connected by an annular ring 49 which fits into an annular groove 21 in the ejector shaft and may there be secured by adhesive, welding or other connecting means. The locking member 50 extends transversely inward from the cantilever 48 toward the ejector shaft 20 adjacent to the conical end thereof and is bent slightly to receive the open end of the tubular upper end section of the ejector arm defining the female receptor 44 as illustrated in FIG. 7. The tab or tabs 54 extends transversely outward from the cantilever for user finger actuation in the manner previously described.

Thus, during installation, the user may depress the push button 24 to move the ejector shaft 20 downwardly within the passage 22 to bring the male connector 46 adjacent the lower end of the passage 22. With an opposite hand, the user positions the ejector arm 40 such that the female receptor 44 comprising the upper tubular portion of the ejector arm receives the male connector 46. In this operation, the locking member 50 is forced outwardly upon engagement with the end of the ejector arm 40 as depicted in FIG. 7. The male connector 46 slides within the female receptor 44 until the locking member 50 passes the end of the tubular portion of the ejector arm to snap inwardly and engage the locking shoulder 52 to axially lock the ejector arm to the ejector shaft as shown in FIG. 8.

To remove the ejector arm 40 from the ejector shaft 20, the procedures illustrated in FIGS. 9 and 10 are followed. Namely, the user depresses the push button 24 to move the ejector shaft 20 to the position shown in FIG. 9. With his other hand he pushes on the tab or tabs 54 and moves the cantilever 48 outwardly to disengage the locking member 50 from the locking shoulder 52. He then pulls axially on the ejector arm 40 to separate the ejector arm from the ejector shaft with the male connector 46 sliding from the female receptor 44 as shown in FIG. 10.

Figure 11:
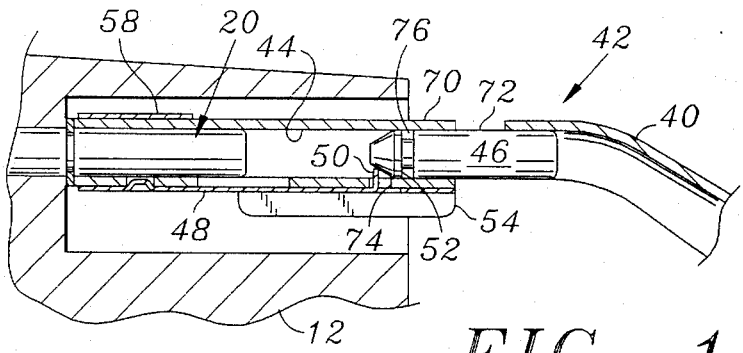
FIG. 11 is an enlarged fragmentary side view similar to FIG. 3 for a third preferred embodiment of the connector of the present invention showing the ejector arm as it is being installed and connected to the ejector shaft by the connector.
Figure 12:
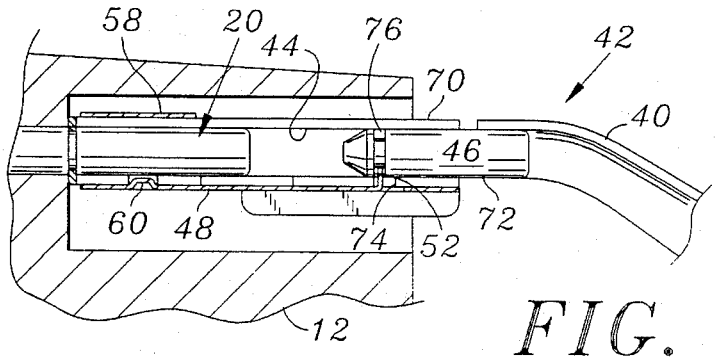
FIG. 12 is an enlarged fragmentary side view similar to FIG. 11 showing the ejector arm connected to the ejector shaft by the third embodiment of the connector.
Figure 13:
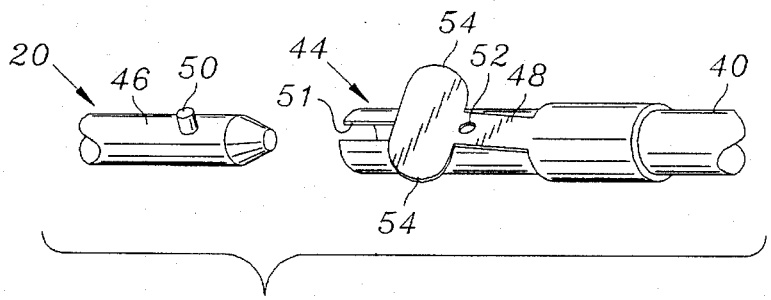
FIG. 13 is a fragmentary perspective view of a fourth embodiment of the connector of the present invention resembling somewhat the connector illustrated in FIGS. 3–6 and showing the ejector shaft separated from the ejector arm for reception by the connector.

A third preferred embodiment of the connector 42 is depicted in FIGS. 11 and 12. In the third embodiment, the female receptor 44 comprises a sleeve 70 secured to the lower end of the ejector shaft to extend coaxially therewith. Such connection may be by welding or adhesive securing an upper end of the sleeve to the lower end of the ejector shaft. The male connector 46 comprises a rod 72 secured as by welding within a tubular upper end of the ejector arm with a conical end of the rod facing the sleeve 70 comprising the female receptor 44. As with the other connectors 42, the connector illustrated in FIGS. 11 and 12 comprises the cantilever 48 secured to the sleeve 70 as by the use the C-shaped channel 58 for the preferred embodiment of the connector 42 illustrated in FIG. 2. The cantilever 48 carries the locking member 50 comprising a finger which extends transversely inward through an opening 74 in the sleeve 70 to engage the conical end of the male connector 46 as it is inserted into the sleeve as illustrated in FIG. 11. The conical end of the male connector 46 is separated therefrom by an annular groove 76 as in FIG. 3. Thus, to install the ejector arm 40 to the ejector shaft 20 with the third embodiment of the connector 42, the user may simply press on the push button 24 to move the ejector shaft 20 to the open end of the passage 22 and insert the male connector 46 into the sleeve 70 comprising the female receptor 44. In doing this, the locking member 50 engages the conical end of the male connector to move the locking member outward as the male connector slides within the female receptor 44. Upon reaching the annular groove 76, the locking member 50 snaps inwardly to engage the locking shoulder 52 as shown in FIG. 12 thereby axially locking the ejector arm 40 to the ejector shaft 20.

As with the other embodiments, to remove the ejector arm 40 from the ejector shaft 20, the user simply depresses the push button 24 to move the ejector shaft to the end of the passage 22. The user then pushes on the tab or tabs 54 to move the cantilever 48 outward to disconnect the locking member 50 from the locking shoulder 52 and pulls axially on the ejector arm to separate the ejector arm from the ejector shaft for cleaning, servicing or replacement of the ejector arm or operation of the pipette without the ejector arm to allow access to smaller vessels.

In the first three embodiments of the present invention described here and above, the locking member 50 was carried by the cantilever 48. Alternative embodiments of the present invention as illustrated in FIGS. 13–21, are structured with the locking shoulder 52 defined by hole or slot in the cantilever while the locking member 50 extends laterally outward from the male connector 46 or the female receptor 44. Thus, in the fourth embodiment of the connector of the present invention shown in FIGS. 13 and 14, the ejector shaft 20 carries the male connector 46 as in the embodiments illustrated FIGS. 3–6. The male connector 46 is dimensioned for reception by the female receptor 44 extending axially from the end of the ejector arm 40 in the manner previously described with respect to FIGS. 3–6. The locking member 50 however extends laterally outward from the male connector as illustrated and is dimensioned to ride in a key way or slot 51 in a side surface of the female receptor 44 as the ejector arm 40 is moved axially towards the ejector shaft 20. Further, the cantilever 48 rather that extending downwardly from the end of the ejector arm 40 comprising the female receptor 44, extends axially toward the ejector shaft 20. The manner of connection for the cantilever 48 to the ejector arm 40 may be the same as illustrated and described with respect to FIGS. 3–6.

Figure 14:
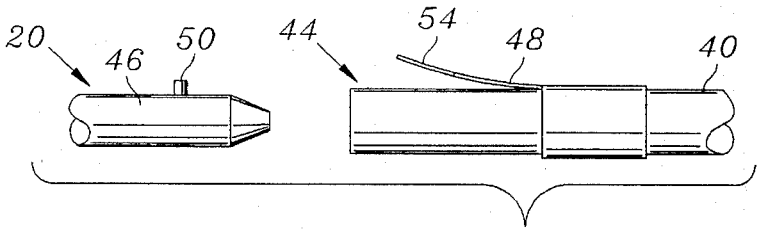
FIG. 14 is a fragmentary side view of the fourth embodiment of the connector of the present invention illustrated in FIG. 13.

Thus, in the fourth embodiment of the connector of the present invention, as the male connector 46 is received by the female receptor 44, the locking member 50 rides in the key way or slot 51 and engages the cantilever 48 flexing it outwardly to the position illustrated in FIG. 14. Such axially movement of the ejector arm 40 relative to the ejector shaft continues until the locking member 50 reaches the slot or opening in the cantilever 48 defining the shoulder 52. As that occurs, the cantilever 48 snaps downwardly onto the male connector to secure the locking member 50 against the locking shoulder 52 to secure the ejector arm 40 to the ejector shaft 20.

When it is desired to separate the ejector arm 40 from the ejector shaft 20, the user simply repeats the previously described removal operation by pressing downward on the push button to move the ejector shaft 20 downwardly to expose the connector. With the connector exposed, the user simply contacts the tabs 54 and flexes the cantilever 48 away from the female receptor 44 to release the locking member 50 from the locking shoulder 52. The user can then slide the ejector arm from the ejector shaft with the locking member 50 riding in the key way or slot 51.

A similar structure is illustrated in FIGS. 15–18. The difference being that the parts are reversed from the format illustrated in FIGS. 11 and 12 with the male connector extending from the ejector arm 40 and with the female receptor 44 extending from the ejector shaft 20. The balance of the structure of the connector is as described with respect to FIGS. 13 and 14 with the locking member 50 extending laterally outward from the male connector 46 for reception by a key way or slot 51 in the female receptor 44.

Figure 15:
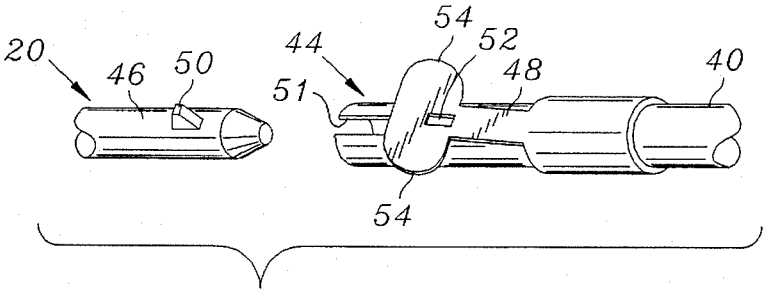
FIG. 15 is a fragmentary perspective view of a fifth embodiment of the connector of the present invention showing the ejector shaft separated from the ejector arm.
Figure 16:
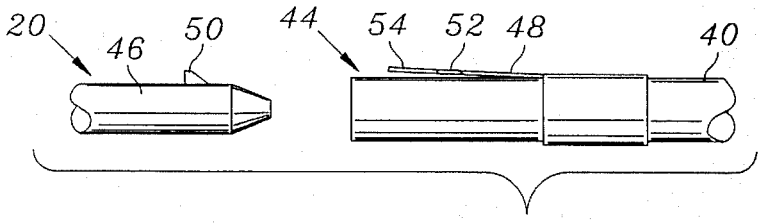
FIG. 16 is a fragmentary side view of the connector illustrated in FIG. 15 with the ejector shaft separated from the ejector arm.
Figure 17:
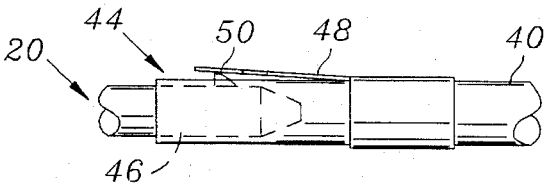
FIG. 17 is a fragmentary side view of the connector shown in FIG. 16 with a male connector portion of the ejector arm received by a female receptor portion of the connector extending from the ejector shaft.
Figure 18:
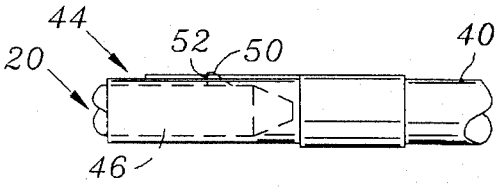
FIG. 18 is a fragmentary side view similar to FIG. 17 showing the male connector locked to the female receptor to secure the ejector shaft to the ejector arm.

The steps of attachment of the ejector arm 40 to the ejector shaft 20 with the sixth embodiment of the connector illustrated in FIG. 15 is most clearly depicted in FIGS. 16, 17 and 18. In FIG. 16, the ejector arm 40 is shown separated from the ejector shaft 20. In FIG. 17, the male connector 46 of the ejector arm is shown partially inserted into the female receptor 44 with the locking member 50 comprising a sloping cam surface engaging the underside of the cantilever 48 to flex the cantilever outward. FIG. 18 illustrates the male connector 46 locked to the female receptor 44 which occurs when the locking member 50 engages the opening defining the locking shoulder 52 to allow the cantilever 48 to snap over the locking member to secure the ejector to the ejector shaft.

To separate the ejector arm 40 from the ejector shaft 20, the user simply repeats the removal procedure previously described for the prior embodiments of the invention.

Figure 19:
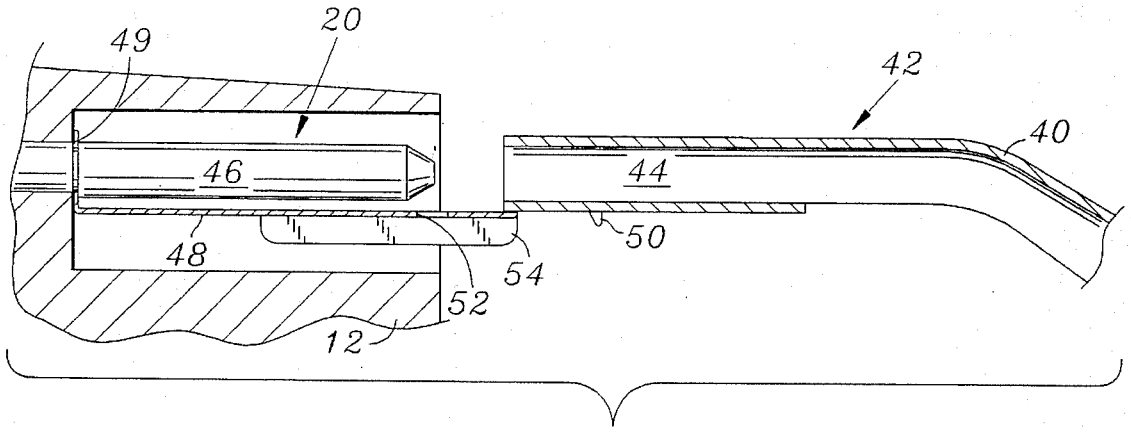
FIG. 19 is a fragmentary side view of a sixth embodiment of the connector of the present invention showing the ejector shaft separated from the ejector arm for reception by the connector.
Figure 20:
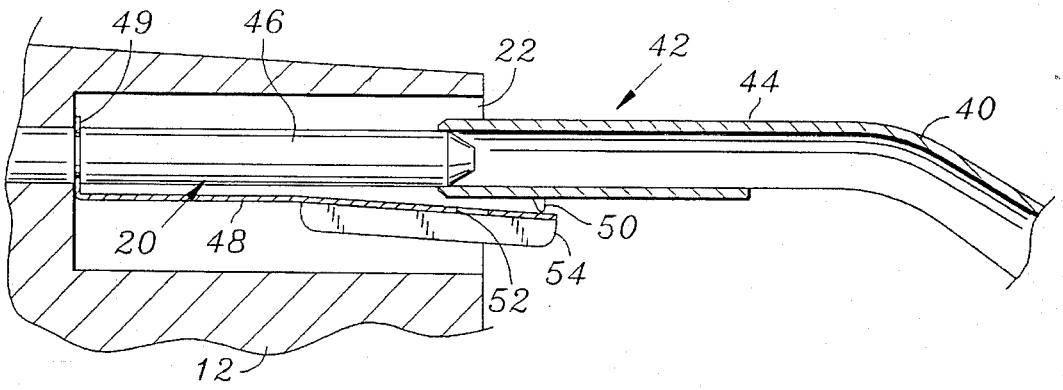
FIG. 20 is a fragmentary side view similar to FIG. 19 showing the ejector arm adjacent to the ejector shaft with a male connector extending from the ejector shaft entering a female receptor extending from the ejector arm.
Figure 21:
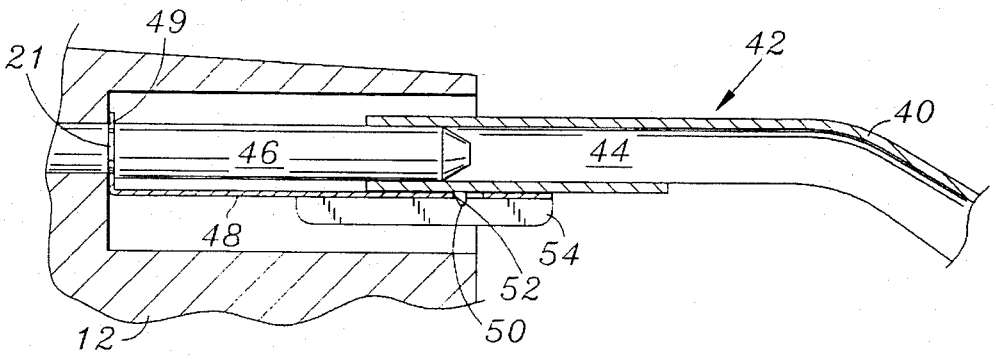
FIG. 21 is a fragmentary side view similar to FIG. 20 showing the male connector locked within the female receptor to secure the ejector arm to the ejector shaft.

A seventh embodiment of the connector of the present invention is illustrated in FIGS. 19–21 and is similar to that previously described in connection with FIGS. 7–10. In that regard however, the locking member 50 rather than extending from the cantilever 48, extends outwardly from the female receptor 44 comprising the end of the ejector arm 40. Also, the locking shoulder 52 rather than comprising an end of the female receptor, comprises a slot or opening defining the locking shoulder 52 as shown most clearly in FIG. 19. FIG. 19 shows the ejector arm 40 separated from the ejector shaft 20 with the connector ready to receive and interconnect the ejector arm to the ejector shaft.

In FIG. 20, the ejector arm 40 is immediately adjacent the male connector 46 extending from the ejector shaft 20 and the male connector is ready for insertion into the female receptor 44.

In FIG. 21, the male connector 46 is locked within the female receptor 44 by the locking member 50 seating within the opening defining the locking shoulder 52. Again, the locking member 50 includes a sloped cam surface which upon engaging the end of the cantilever deflects the cantilever 48 outward. When the locking member 50 engages the opening defining the locking shoulder 52, the cantilever snaps onto the outer surface of the female receptor 44 releaseably locking the ejector arm to the ejector shaft.

Again, to remove the ejector arm 40 from the ejector shaft 20 with the seventh embodiment of the present invention simply requires the user to follow the removal procedure previously described.

From the foregoing description, it is appreciated that the present invention provides an improved pipette tip ejector mechanism which allows its ejector arm to be easily locked to its ejection shaft to form a solid connection which will not wear or separate upon repeated tip ejection operations. The present invention further provides an improved pipette tip ejector mechanism which allows its ejector arm to be easily removed from its ejector shaft without any possible injury to the user and without requiring the exertion of a hard pulling action on the ejector arm as is common in prior ejector mechanisms.

What is claimed is:

1. In a pipette comprising a axially elongated housing having a hand-holdable upper end portion and a lower open end portion for releasably receiving a removable pipette tip, a pipette tip ejector mechanism, comprising:

a vertically extending passage through the upper portion of the housing and having a lower open end;

a pipette tip ejector shaft;

support means within the passage for supporting the shaft for manual axial movement within the passage between an upper position with a lower end of the shaft within the passage and a lower position with the lower end of the shaft exposed below the lower open end of the passage;

spring means for urging the shaft to its upper position;

a push button at an upper end of the shaft for downward pushing of the shaft to the lower position;

a pipette tip ejector arm having an upper end for releasable connection to the lower end of the shaft and extending along an outer surface of the housing to the lower end thereof adjacent an upper end of the pipette tip to exert a downward force on and eject the pipette tip from the housing upon movement of the shaft from the upper to lower positions; and a connector within the passage, the connector extending between the lower end of the shaft and the upper end of the arm within the passage and comprising a female receptor extending from a one of the shaft or arm, a male connector extending from another of the shaft or arm axially into the female receptor for support thereby, a cantilever secured at one end to a one of the shaft or arm to extend along an outer surface of another of the shaft or arm within the passage and carrying one of a locking member or a locking shoulder for engaging the other of the locking member or locking shoulder on the other of the shaft or arm to axially lock the arm relative to the shaft and including a tab within the passage at the lower open end and extending transversely outward from the cantilever for finger contact by a user when the shaft is in the lower position to outwardly move the cantilever to disengage the locking member from the locking shoulder to release the arm for axial movement relative to the shaft to separate the arm from the pipette for cleaning, service or replacement.

2. The pipette tip ejector mechanism of claim 1 wherein the female receptor extends from the shaft and the male connector extends from the arm.

3. The pipette tip ejector of claim 1 wherein the female receptor extends from the arm and the male connector extends from the shaft.

4. The pipette ejector of claim 1 wherein the locking member is carried by the cantilever.

5. The pipette ejector of claim 1 wherein the locking shoulder is carried by the cantilever.

6. The pipette ejector tip ejector mechanism of claim 1 wherein the female receptor extends from the arm and the male connector extends from the shaft and the cantilever extends from the arm with the locking member extending inwardly to engage a locking shoulder on the shaft.

7. The pipette tip ejector mechanism of claim 1 wherein the female receptor extends from the arm and the male connector extends from the shaft and the cantilever extends from the arm and carries the locking shoulder to engage the locking member extending outwardly from the shaft.

8. The pipette tip ejector of claim 1 wherein the female receptor extends from the arm and the male connector extends from the shaft and the cantilever extends from the shaft along an outer surface thereof with the locking member extending inwardly toward the ejector shaft to engage a locking shoulder carried by the ejector arm.

9. The pipette ejector of claim 1 wherein the female receptor extends from the arm and the male connector extends from the shaft and the cantilever extends from the shaft along the outer surface thereof and carries the locking shoulder to engage the locking member extending outwardly from the ejector arm.

10. The pipette tip ejector of claim 1 wherein the female receptor extends from the shaft and the male connector extends from the arm and the cantilever extends from the shaft along an outer surface of the female receptor with the locking member extending transversely inward to lock against a locking shoulder on the arm.

11. The pipette tip ejector of claim 1 wherein the female receptor extends from the shaft and the male connector extends from the arm and the cantilever extends from the shaft along an outer surface of the female connector with the locking shoulder carried by the cantilever to engage and lock against a locking member on the ejector arm.

12. The pipette tip ejector of claim 1 wherein the connector comprises a spring clip connector including a channel for connection to one of the shaft or arm with a cantilever secured at one end to the channel to extend there along and carry the locking member to extend transversely inward toward the other of the shaft or arm to engage a locking shoulder on the other of the shaft or arm to axially lock the arm relative to the shaft and wherein the tab extends transversely outward from the cantilever for finger contact by a user.

13. The pipette ejector of claim 1 wherein the connector comprises a spring clip connector including a channel for connection to one of the shaft or arm with a cantilever secured at one end of the channel to extend there along and carry a locking shoulder for engaging an outwardly extending locking member on the other of the shaft or arm to axially lock the arm relative to the shaft and wherein the tab extends transversely outward from the cantilever for finger contact by a user.

* * * * *